US009535445B2

(12) United States Patent
Whitten

(10) Patent No.: US 9,535,445 B2
(45) Date of Patent: Jan. 3, 2017

(54) TRANSISTOR MATCHING FOR GENERATION OF PRECISE CURRENT RATIOS

(71) Applicant: Lattice Semiconductor Corporation, Hillsboro, OR (US)

(72) Inventor: Trent Whitten, Portland, OR (US)

(73) Assignee: LATTICE SEMICONDUCTOR CORPORATION, Hillsboro, OR (US)

( * ) Notice: Subject to any disclaimer, the term of this patent is extended or adjusted under 35 U.S.C. 154(b) by 210 days.

(21) Appl. No.: 14/245,920

(22) Filed: Apr. 4, 2014

(65) Prior Publication Data

US 2015/0286240 A1 Oct. 8, 2015

(51) Int. Cl.
*G05F 3/00* (2006.01)
*G05F 3/26* (2006.01)

(52) U.S. Cl.
CPC ..... *G05F 3/262* (2013.01)

(58) Field of Classification Search
CPC ..... G05F 3/00; G05F 3/02
See application file for complete search history.

(56) References Cited

U.S. PATENT DOCUMENTS

| | | | | |
|---|---|---|---|---|
| 6,160,305 | A | 12/2000 | Sanchez | |
| 6,554,469 | B1 | 4/2003 | Thomson et al. | |
| 7,332,952 | B2 * | 2/2008 | McLeod | G01K 7/01 327/378 |
| 7,461,974 | B1 | 12/2008 | Aslan et al. | |
| 7,659,772 | B2 * | 2/2010 | Nomura | H03K 19/0008 327/534 |
| 7,915,947 | B2 | 3/2011 | Liu et al. | |
| 8,044,702 | B2 | 10/2011 | Niederberger | |
| 8,096,707 | B2 | 1/2012 | Raychowdhury | |
| 8,308,358 | B2 | 11/2012 | Doorenbos | |
| 9,172,366 | B2 * | 10/2015 | Whitten | H03K 17/14 |

OTHER PUBLICATIONS

Pertijis, Michiel A., et al., A CMOS Smart Temperature Sensor With a 3o Inaccruracy of ±0.1° C From—55° C to 125° C, IEEE Journal of Solid-State Circuits, Dec. 2005, pp. 2805-2815, vol. 40, No. 12, IEEE Journal of Solid-State Circuits.

* cited by examiner

*Primary Examiner* — Hai L Nguyen
(74) *Attorney, Agent, or Firm* — Haynes and Boone, LLP

(57) ABSTRACT

Systems and methods are provided for generating accurate current ratios from a current mirror including an array of output transistor and a corresponding array of switches. Each switch couples in series with its corresponding output transistor. A control logic circuit controls the switches to cancel mismatches for the output transistors.

14 Claims, 11 Drawing Sheets

TRANSISTOR MATCHING FOR GENERATION OF PRECISE CURRENT RATIOS

TECHNICAL FIELD

The present invention relates generally to integrated circuits, and more particularly to an array of transistors configured to generate precise current ratios.

BACKGROUND

PNP bipolar transistors are readily produced in CMOS integrated circuits as parasitic substrate devices. This is quite advantageous as bipolar transistors have an emitter-to-base voltage ($V_{eb}$) that varies predictably with regard to temperature. The temperature of integrated circuits may thus be readily monitored using a bipolar transistor as a temperature transducer. Because a bipolar transistor may be inexpensively embedded with the circuits it monitors, bipolar transistor temperature transducers are attractive options to a circuit designer.

Although bipolar transistor temperature transducers are inexpensive, they suffer from a number of problems. For example, it is known that if the collector current for a bipolar transistor is changed from a first collector current value $I_{C1}$ to a second collector current value $I_{C2}$, a resulting change in emitter-to-base voltage ($\Delta V_{eb}$) is directly proportional to a product of the absolute temperature T and the logarithm of a ratio of the collector currents ($I_{C2}/I_{C1}$). If $I_{C2}$ equals $N*I_{C1}$, then the temperature is proportional to $\Delta V_{eb}$ divided by the logarithm of N. This logarithm of N may be stored in memory such that the temperature measurement merely requires mapping $\Delta V_{eb}$ by some proportionality factor.

The accuracy of the temperature measurement is thus a function of the accuracy for the collector current ratio generation. Generation of the varying collector currents involves the use of a current source and matched transistors. Ideally, the matched transistors are perfectly identical in order to generate accurate current ratios. Nevertheless, in a real circuit, the matched transistors are not perfectly identical and include slight variations that result in deviations in current outputs. The deviations in the current outputs caused by the slight mismatching among the matched transistors may cause inaccurate current ratios that adversely affect the temperature measurements of the bipolar transistor temperature transducer.

One conventional approach to mitigate the variations in the current outputs of matched transistors is to increase the area of the transistors. For example, the trend for transistor matching is closely approximated by 1/√(the device area). Thus, a device size that leads to 1% matching would need to grow 100 times in size to meet a 0.1% matching requirement. As such, this conventional approach is prohibitively expensive due to the increase in silicon area required in the transistor device.

Other approaches may include methods of random dynamic element matching. In particular, pure random and data-weighted methods are typically used in systems including Analog-to-Digital Converters (ADCs). In order to match currents in both absolute and relative values, all possible combinations of elements that may create the necessary output quantity are required to be involved in the process. As such, a large sample of the combinations must be implemented during the operation of interest, e.g., temperature measurement, so that the true mean of the population of device combinations may be realized. Thus, this approach increases design complexity and lengthens the temperature measurement cycle.

Accordingly, there is a need in the art for an array of matched transistors that generate accurate current ratios.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1A:
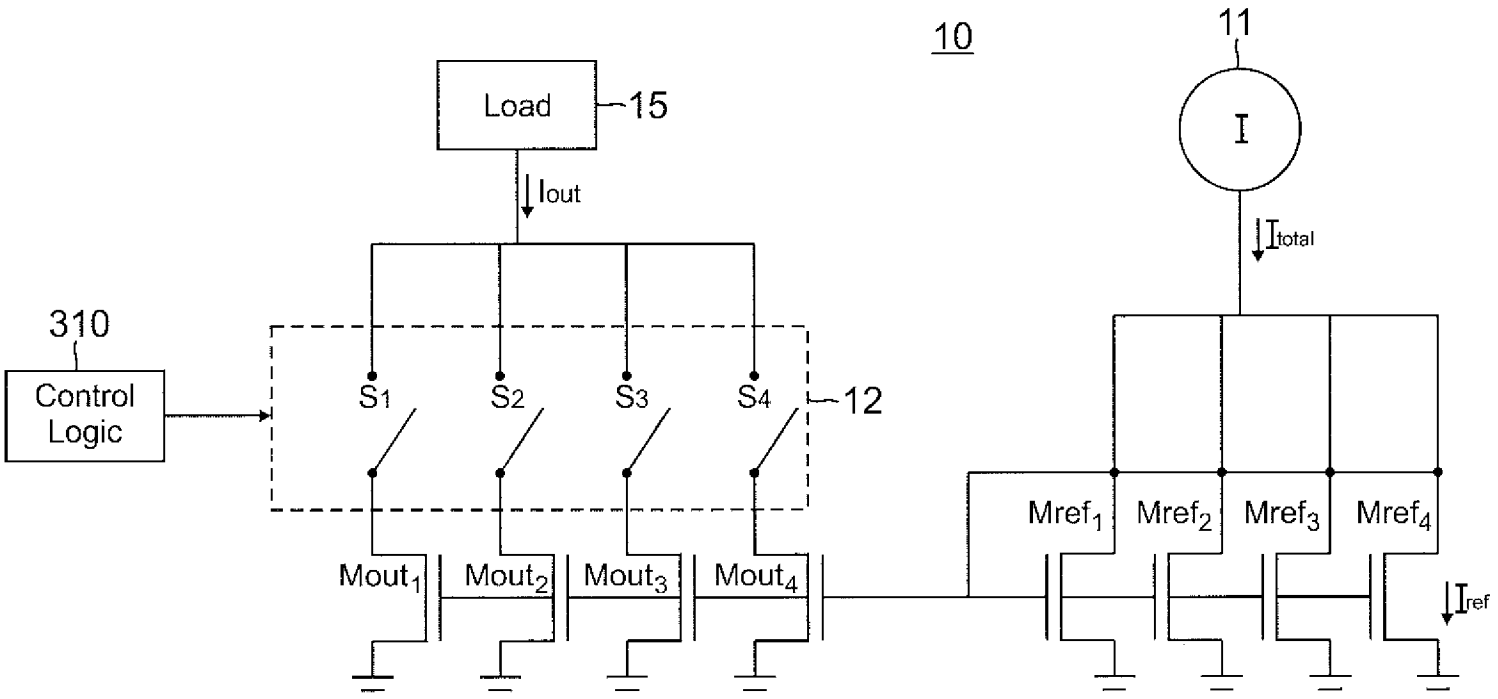
FIG. 1A is a schematic diagram of a current mirror in accordance with an embodiment of the disclosure.

Reference will now be made in detail to one or more embodiments of the invention. While the invention will be described with respect to these embodiments, it should be understood that the invention is not limited to any particular embodiment. On the contrary, the scope of the disclosure includes alternatives, modifications, and equivalents as may come within the spirit and scope of the appended claims. Furthermore, in the following description, numerous specific details are set forth to provide a thorough understanding of the invention. The invention may be practiced without some or all of these specific details. In other instances, well-known structures and principles of operation have not been described in detail to avoid obscuring the invention.

Overview

A current driver is provided that maintains an output current such as a bipolar transistor's collector current ($I_C$) at a target value. The current driver includes a current source that drives an input current into a current mirror including a plurality of M reference transistors such that each reference transistor in the plurality conducts a reference current equaling 1/Mth of the input current, where M is a plural integer. The current mirror includes a plurality of M output transistors and a plurality of M switches corresponding to the plurality of M output transistors. Each switch couples in series with its corresponding output transistor to selectively control whether current flows through the corresponding output transistor. The reference and output transistors are matched to each other such that the various transistors are substantially identical. Depending upon the number of switches that are turned on, the total current conducted by the plurality of output transistors will equal some multiple of the reference current conducted by each of the reference transistors. For example, if just one switch is on, the total current conducted by the plurality of output transistors would equal the reference current. If two switches were on, the total current would be twice the reference current, and so on.

The total current conducted by the plurality of M reference transistors is M times the reference current, which equals the input current from the current source. The total current conducted by the plurality of output transistors is thus (N/M) times the input current, where N represents the number of switched-on switches. A control logic circuit controls the switches with a control signal and thus controls the number N of switched-on switches (the default state for the switches being off).

To provide N switched-on switches in the plurality of M switches, a simple solution would be to turn on the first N switches in the plurality of M switches. But as noted above, there remain slight variations among the matching transistors that may result in inaccurate current ratios. To mitigate this deficiency, the control logic circuit periodically changes which switches are on and which switches are off in a current generation time cycle. In other words, suppose that N of the M switches are to be on. During a current generation time cycle, the control logic generates the control signal such that each switch is switched on the same number of times in the current generation time cycle. For example, suppose the current driver includes four switches labeled A, B, C, and D and that the desired total current conducted by the plurality of M output transistors requires that two of four switches be switched on. The current generation time cycle may then be divided into four frames. In a first frame in the current generation time cycle, switches A and B may be switched on while switches C and D are off. In a second frame, switches B and C may be on while switches A and D are off. Similarly, a third frame may have switches C and D while switches A and B are off. Finally, a fourth frame may have switches A and D on while switches B and C are off. Over the four frames, each switch is thus on the same number of times (in this case, twice). The total current conducted by the plurality of M output transistors is averaged over all the frames in the current generation time cycle.

This cycling through of the on state for the switches is quite advantageous. For example, suppose the matching error for the output transistor corresponding to switch A is represented by an error term 1. Similarly, an error term 2 may represent the matching error for the output transistor corresponding to switch B, and so on such that the total matching error for the four output transistors may be represented by Δ, where Δ equals the sum (error term 1+error term 2+error term 3+error term 4). The averaged total current conducted by the plurality of M output transistors across the current generation cycle will thus always be proportional to the input current from the current source plus the total error term Δ. For example, suppose that during one current generation cycle, all four switches were on for the example embodiment discussed above. The total current conducted by the plurality of M output transistors will then equal the input current plus Δ. In another current generation cycle, suppose that just two switches are turned on in any given frame, with each switch being switched on the same number of times over the current generation cycle as discussed above. The resulting total current conducted by plurality of M output transistors will then be ½ (the input current plus Δ). A ratio of these two currents is then just ½ since the sum (input current and the total error term Δ) cancels. These concepts and features may be better understood with regard to the following example embodiments.

Example Embodiments

FIG. 1A illustrates an exemplary current driver 10. A current source 11 may drive an input current $I_{total}$ into a set of four (4) parallel-arranged NMOS reference transistors $M_{ref1}$ to $M_{ref4}$. Each reference transistor conducts a reference current $I_{ref}$ that ideally equals ¼ of the input current. More generally, if there were M reference transistors (M being an integer greater than one), the reference current conducted by each reference transistor would equal (1/M)th of the input current. These reference transistors are in a current mirror configuration with a plurality of NMOS output transistors $M_{out1}$ to $M_{out4}$. The reference and output transistors are all matched to each other. It will be appreciated that alternative embodiments may be constructed using PMOS transistors. To form an NMOS current mirror, the drains and gates of the reference transistors are all coupled together so that they are guaranteed to be in the saturation mode. The drains of the reference transistors also couple to the gates of the output transistors. A plurality 12 of switches $S_1$ through $S_4$ corresponds to the plurality of output transistors. The drain of each output transistor couples through its corresponding switch to a load 15. For example, the drain of output transistor $M_{out1}$ couples through switch $S_1$ to load 15. Similarly, the drain of output transistor $M_{out2}$ couples through switch $S_2$ to load 15, and so on for the remaining output transistors.

The switches are controlled by a control signal from a control logic circuit 310. For example, if each switch is implemented by a transistor (e.g., an NMOS transistor), then the control signal may be implemented as a 4-bit control word, where each bit in the 4-bit control word controls the gate of a corresponding switch transistor. If the control signal is such that just $S_1$ is closed then only output transistors $M_{out1}$ will conduct the reference current. The remaining output transistors $M_{out2}$ to $M_{out4}$ will not conduct any current since their corresponding switches $S_2$ through $S_4$ are open in their default state. An output current $I_{out}$ conducted through load 15 would then equal the reference current. Similarly, if all four switches were closed, $I_{out}$ would then equal to four*$I_{ref}$ (or $I_{total}$). In this fashion, the output current $I_{out}$ sunk into ground by the conducting output transistors equals N*the reference current, where N is the number of switches driven on by control logic circuit 310.

Although the above exemplary current mirror utilizes two sets of four transistors each, it will be appreciated that the number M of transistors in each plurality is a design choice such that M may be less than or greater than four in alternative embodiments. If N of the M switches are switched on, the output current $I_{out}$ conducted through load 15 will be proportional to N/M times the input current.

In an ideal circuit, the output transistors are identical in their characteristics to the reference transistors. Nevertheless, in a real circuit, each output transistor has slightly different characteristics from each other and from the reference transistors. As such, the output current $I_{out}$ sunk into ground by the N conducting output transistors deviates from the desired N multiple of the reference current. The current sunk into ground by each conducting output transistor thus equals the reference current $(I_{ref})+\Delta I_i$, where i represents the index for the output transistor (in this embodiment, one through four). A variable ΔI may thus represent the total current deviation when all the output transistors are conducting. The total current deviation ΔI equals the sum of the current deviations output from each transistor $M_{out1}$, $M_{out2}$, $M_{out3}$, and $M_{out4}$. More generally, for M output transistors the total current deviation ΔI equals $(\Delta I_1+\Delta I_2+\Delta I_3+\Delta I_4+\Delta I_5 \ldots \Delta I_M)$.

To mitigate these deviations resulting from the real-world mismatches in the output transistors, a control logic circuit 310 may change the combinations of conducting output transistors with regard to frames within a cyclically repeated current generation cycle. The number of frames equals the number M of output transistors. For example, if there are four output transistors, there are four frames (or a multiple of four). In each frame, control logic circuit 310 switches on N of the switches, N being a positive integer of M or less. The number N depends upon the desired magnitude of the output current conducted through load 15 and through the conducting output transistors. But regardless of what N is, the control logic circuit 310 controls the switches such that each switch (and thus the corresponding output transistor) is conducting the same total number of frames across the current generation cycle. For example, suppose just one of the switches $S_1$ through $S_4$ is switched on in any given frame. Control logic circuit 310 would then alternate the switches such that each switch is turned on only in its corresponding frame. The average output current across all the frames would then be just the reference current, which is ¼ $I_{total}$. The average error across the frames would also be ¼ of the total current deviation Δ. So the average output current in this example current generation cycle would be $(1/4)*(I_{total}+\Delta)$. It is readily seen that the average current will be $(N/M)*(I_{total}+\Delta)$, regardless of the particular value for N so long as N is a positive integer of M or less. The selection of alternative combinations of switches across the frames by control logic circuit 310 such that each switch is on for the same number N of frames in the current generation cycle is thus quite advantageous since the input current plus the total error term Δ always cancels in a ratio of output currents from the output transistors. The error term may thus be disregarded despite the real-world mismatches for the output transistors.

Figure 1B:
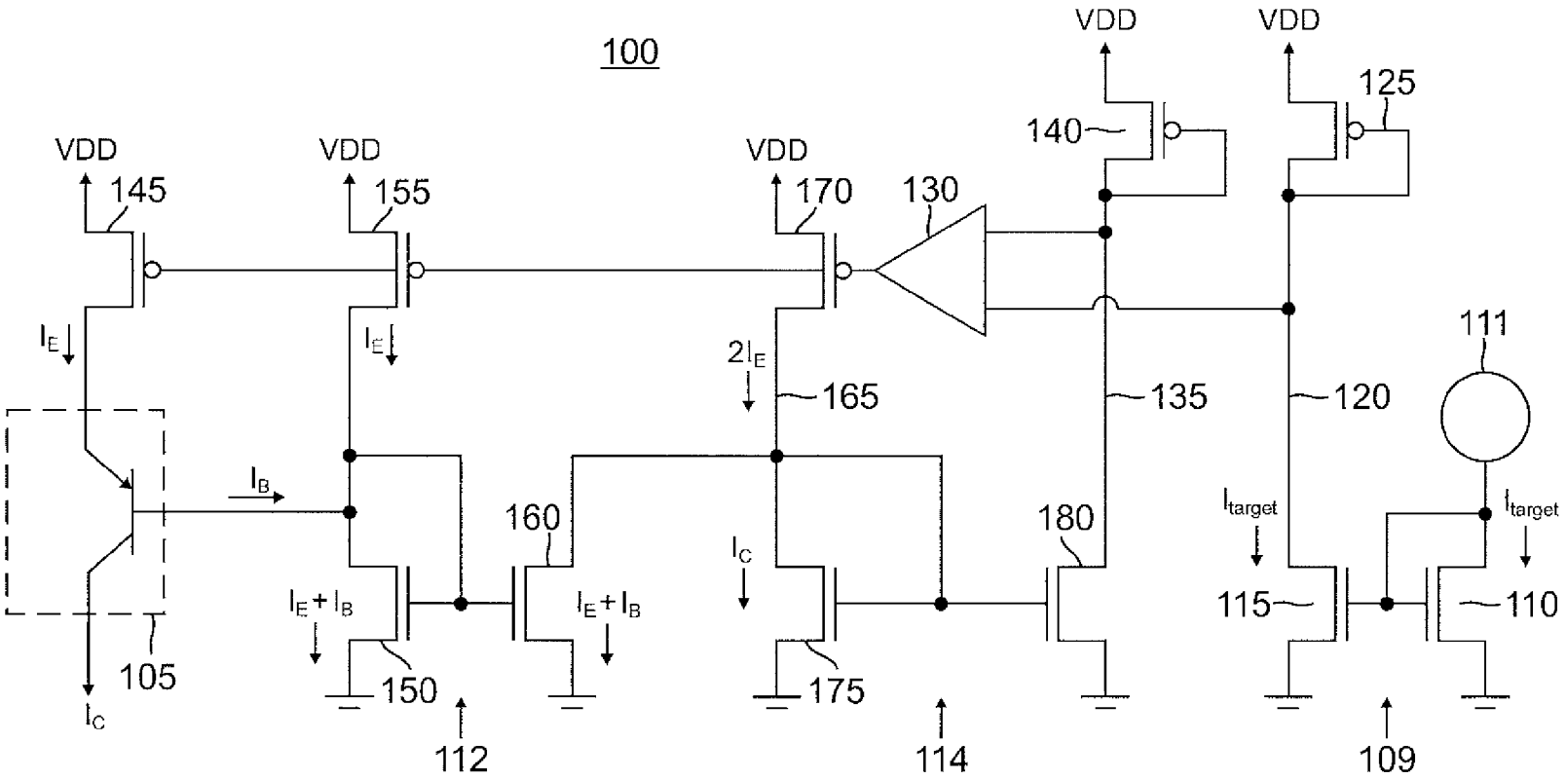
FIG. 1B is a schematic diagram of a bipolar transistor temperature transducer and an associated collector current driver in accordance with an embodiment of the disclosure.

Current driver 10 may be advantageously included in any circuit that requires the generation of accurate current ratios. A prime example of such a circuit is a bipolar transistor temperature transducer. Thus, although the following examples are directed to bipolar temperature transducers, it will be appreciated that other circuits may also include the current drivers disclosed herein. FIG. 1B illustrates an example collector current driver 100 for a PNP bipolar transistor temperature transducer 105 that may utilize the disclosed control logic to produce accurate current ratios. A current source 111 drives a target collector current target $(I_{target})$ into an NMOS transistor 110 in a current mirror 109 that also includes an NMOS transistor 115. A drain and gate of NMOS transistor 110 are coupled in a current mirror configuration to a gate of NMOS transistor 115 such that NMOS transistor 115 is configured to conduct a duplicate of $I_{target}$ into ground. A first current path 120 supplies $I_{target}$ to a drain of NMOS transistor 115. First current path 120 includes a first load such as a diode-connected PMOS transistor 125 having its source coupled to a power supply node supplying a power supply voltage VDD and a drain coupled to a drain of NMOS transistor 115. The drain of PMOS transistor 125 also couples to a first input node for a differential amplifier 130. A resulting voltage at the drain of PMOS transistor 125 equals VDD minus the Ohm's law product of the resistance for PMOS transistor 125 and $I_{target}$. It is this voltage that drives the first input of differential amplifier 130.

A second load such as a diode-connected PMOS transistor 140 also has its source coupled to the power supply node and a drain coupled to a second current path 135. The drain of PMOS transistor 140 couples to a second input node for differential amplifier 130. Based upon the current driven through second current path 135 a voltage thus develops at the drain of diode-connected PMOS transistor 140 that drives the second input to differential amplifier 130. As will be discussed further herein, a negative feedback from differential amplifier 130 controls the current conducted through second current path 135 such that second current path 135 also conducts a duplicate of $I_{target}$. The following discussion will show that collector current driver 100 is configured to make a collector current $I_C$ for transducer 105 also equal $I_{target}$.

To make $I_C$ equal $I_{target}$, differential amplifier 130 drives the gate of an output PMOS transistor 145 with a feedback voltage responsive to an amplification of a difference between its two input voltages as produced at the drains of PMOS transistors 140 and 125. Output transistor 145 has its source coupled to the power supply node and a drain coupled to the emitter of transducer 105. Output transistor 145 thus sources an emitter current $I_E$ to transducer 105 responsive to the negative feedback voltage from differential amplifier 130. As known in the differential amplifier arts, negative feedback from a differential amplifier such as differential amplifier 130 functions to keep its input voltages equal. The negative feedback from differential amplifier 130 thus keeps the currents in first current path 120 and second current path 135 equal. This same negative feedback also controls $I_E$ through output transistor 145.

Differential amplifier 130 also drives a gate of a first duplicate output PMOS transistor 155 with the feedback voltage. First duplicate output transistor 155 has the same size as output transistor 145. In addition, first duplicate output transistor 155 has the same source voltage as output transistor 145 since a source for first duplicate output transistor 155 is coupled to the power supply node. First duplicate output transistor 155 is thus matched to output transistor 145 in that it has the same gate-to-source voltage and has the same size. Accordingly, a drain current for first duplicate output transistor 155 equals $I_E$. The drain of first duplicate output transistor 155 couples to a drain of a sum current NMOS transistor 150 in a current mirror 112. A base terminal for transducer 105 is also coupled to the drain of sum current transistor 150. A base current $I_B$ from transducer 105 thus drives the drain of sum current transistor 150 that also receives the $I_E$ duplicate current from first duplicate output PMOS transistor 155. A source of sum current transistor 150 that is coupled to ground thus sinks a sum current equaling a sum of $I_E$ and $I_B$ into ground.

Current mirror 112 also includes an NMOS mirror transistor 160 that has its source tied to ground. Sum current transistor 150 has its drain and gate tied to a gate of mirror transistor 160. Current mirror 112 is thus configured such that mirror transistor 160 sinks a duplicate of the sum current ($I_E$+$I_B$) into ground. A feedback current path 165 couples to a drain of mirror transistor 160. With regard to a current conducted through feedback current path 165, differential amplifier 130 drives a gate of a double duplicate output PMOS transistor 170 with the feedback voltage. A source of double duplicate output transistor 170 couples to the power supply node whereas its drain couples to feedback current path 165. If double duplicate output transistor 170 was the same width as output transistor 145, it would thus be matched to output transistor 145 as discussed earlier for first duplicate output transistor 155. But double duplicate output PMOS transistor 170 is configured to be twice the width of output transistor 145. In that regard, double duplicate output transistor 170 may comprise a single transistor of twice the size of output transistor 145 or a pair of duplicate output transistors coupled in parallel between the power supply node and feedback current path 165. Regardless of whether double duplicate output PMOS transistor 170 comprises a plural or single transistor, its gate and source voltages are the same as those for output transistor 145. Double duplicate output transistor 170 will thus conduct twice the emitter current ($2I_E$) into feedback current path 165.

Feedback current path 165 also provides a drain current to an NMOS difference transistor 175 that has its source coupled to ground. Difference transistor 175 is part of a current mirror 114 that also includes an NMOS mirror transistor 180. Since the current in feedback current path 165 is divided between the drains of mirror transistor 160 and difference transistor 175, a difference current conducted through difference transistor 175 equals the difference between $2I_E$ and the sum current ($I_E$+$I_B$). The difference current conducted through difference transistor 175 into ground thus equals $I_C$. In this fashion, difference transistor 175 and mirror transistor 160 form a difference circuit configured to subtract a sum current equaling a sum of $I_E$ and $I_B$ from a current equaling $2I_E$ to provide a difference current equaling $I_C$.

The drain and gate of difference transistor 175 both couple to a gate of mirror transistor 180. Current mirror 114 is thus configured such that mirror transistor 180 conducts a duplicate of $I_C$ (or equivalently, a duplicate of the difference current). Mirror transistor 180 has its source coupled to ground and a drain tied to second current path 135. Such a configuration is quite advantageous because $T_C$ is then forced to equal $I_{target}$ regardless of the β value for PNP bipolar transistor transducer 105. For example, suppose $I_C$ conducting through second current path 135 does not equal $I_{target}$ conducting through first current path 120. That means that the voltages at the drains of PMOS transistors 140 and 125 will be unequal. In response, the negative feedback from differential amplifier 130 is such that amplifier 130 drives its three transistors 145, 155, and 170 to change $I_E$ sufficiently so that $I_C$ equals $I_{target}$.

The temperature measurement from PNP bipolar transistor temperature transducer 105 may be expressed in the following formula:

$$\Delta V_{be} = \frac{KT}{q} \times \ln(N) \qquad \text{[Equation 1]}$$

Thus, the temperature measurement may be calculated by:

$$T = \Delta V_{be} \times \frac{q}{K \times \ln(N)} \qquad \text{[Equation 2]}$$

where N is a ratio of collector currents ($I_{C2}/I_{C1}$), q is the charge of an electron, K is the Boltzmanns constant, and T is the absolute temperature in Kelvin.

Figure 2A:
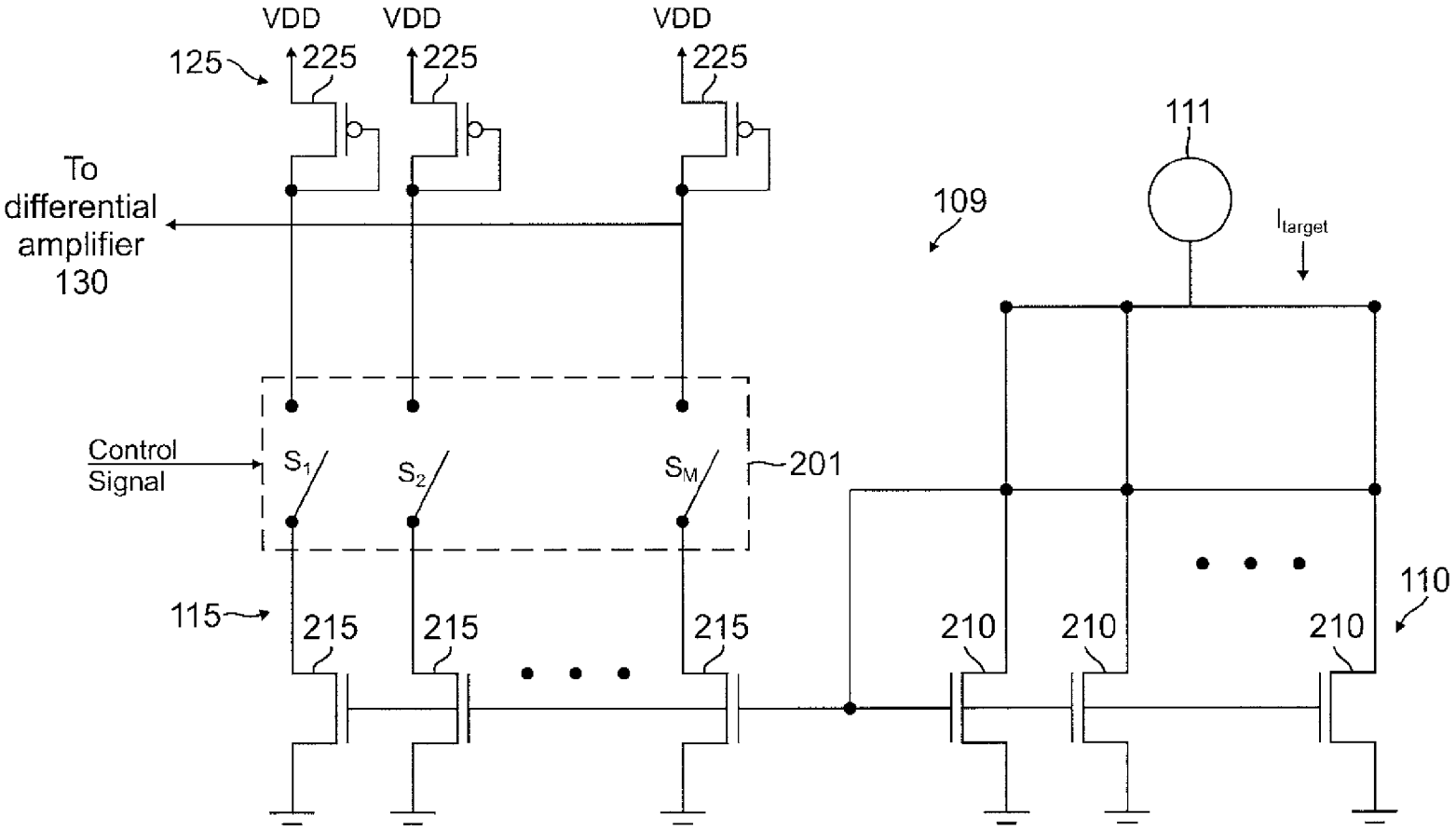
FIG. 2A illustrates an example array of transistors for instantiating the first current mirror in the collector current driver of FIG. 1.

Because the temperature measurement of transducer 105 uses a ratio of two different collector currents, collector current driver 100 needs some means for varying the collector current. For example, current source 111 driving transistor 110 in the first current mirror could be configured to vary its target current. But the changing currents in collector current driver 100 may then lead to less than optimal biasing of the transistors in collector current driver 100 and corresponding measurement errors. A current driver embodiment is shown in FIG. 2A. Referring again to FIG. 1B, if transistors 110 and 115 are matched in current mirror 109, the current mirrored into first current path 135 will match the target current driven into transistor 110 by current source 111. But if, for example, transistor 115 has $1/10^{th}$ the size of transistor 110, then the current mirrored into first current path 135 by the first current mirror will just equal $1/10^{th}$ of the target current from current source 111 (assuming all remaining parameters such as doping and width were matched). Transistors 110 and 115 may thus be instantiated in FIG. 2A by two sets of M transistors each, where M is a plural integer. In this fashion, transistor 110 is instantiated using M NMOS transistors 210 all arranged in parallel between current source I and ground. Similarly, transistor 115 is instantiated using M NMOS transistors 215 also arranged in parallel between transistor 140 and ground. The gates and drains of transistors 210 are tied to the gates of transistors 215 to complete the first current mirror. Transistors 210 and 215 are all matched.

Transistors 215 are an example of the output transistors discussed with regard to FIG. 1A. Similarly, transistors 210 are an example of the reference transistors. Transistors 215 are thus in series with corresponding switches in an array of switches 201 that includes a first switch $S_1$ through an Mth switch $S_M$. In addition, load transistor 125 discussed with regard to FIG. 1A is represented in FIG. 1B by PMOS load transistors 225. Load transistor 125 in turn is an example of load 15 discussed with regard to FIG. 1A. Since there are M transistors 215, there are M load transistors 225. The switches are controlled by a control signal generated by control logic circuit 310 (not illustrated but discussed earlier with regard to FIG. 1A). For example, if each switch is implemented by a transistor (e.g., an NMOS transistor), then the control signal may be implemented as an M-bit control word, where each bit in the M-bit control word controls the gate of the corresponding switch transistor. Suppose the control signal is such that just $S_1$ is closed such that only the transistor 215 has its drain coupled to $S_1$. The remaining transistors 215 will not conduct any current since their corresponding switches are closed. The current mirrored into current path 120 (FIG. 1B) would then equal 1/Mth the target current since transistors 210 and 215 are matched. Similarly, if all M switches were closed, then the current mirrored into current path 120 would equal the target current. In this fashion, the collector current can be varied from 1/Mth of the target current (or 2/Mth and so on) all the way to the target current itself. More generally, if N of the M switches are switched on, the current sunk into ground though the corresponding transistors 215 will be proportional to (N/M) times the target current.

In a real circuit, each transistor 215 has slightly different characteristics from each other. As such, the current from each output transistor 215 has a deviation from the desired value of (1/M) times the target current. As noted above with regard to Equations 1 and 2, the temperature measure of PNP bipolar transistor temperature transducer 105 may be determined from a current ratio of two currents. Thus, an inaccurate current ratio may adversely impact the accuracy of the temperature measurement. Even though the natural log in Equations 1 and 2 may attenuate the impact of ratio error, it may still lead to considerable errors in temperature measurement. For example, a temperature of 300K with 1% error in the current ratio may lead to a 1 degree K error.

Figure 2B:
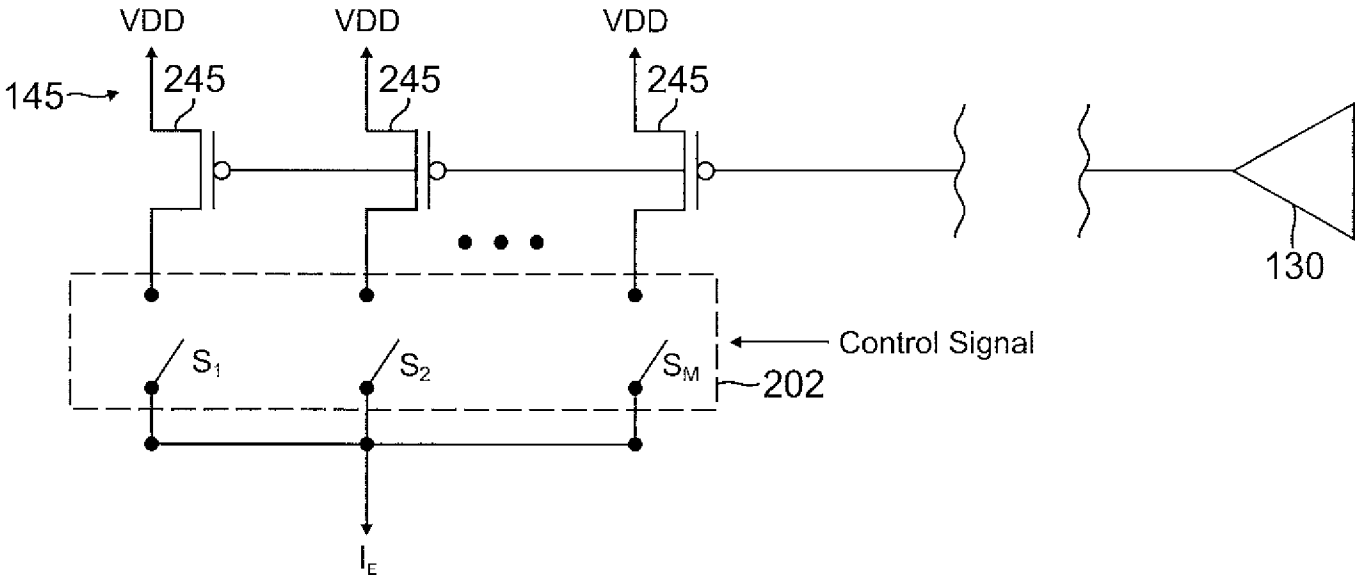
FIG. 2B illustrates an example array of transistors for instantiating the output transistor in the collector current driver of FIG. 1.

In order to mitigate the current deviations resulting from the real-world differences between output transistors 215 and reference transistors 210, a control logic circuit 310 (not illustrated) controls the switches as discussed earlier. There are numerous other transistor arrays that may be controlled in this fashion. For example, FIG. 2B shows an instantiation for output transistor 145 using an array of PMOS transistors 245 coupled in parallel with regard to the power supply node. Each transistor 245 has its gate driven the negative feedback signal from differential amplifier 130 as described with regard to output transistor 145. The drain for each transistor 245 couples through a corresponding switch from a switch array 202.

Referring again to FIG. 2A, if there are M transistors 215 used to implement transistor 115, then M transistors 245 would instantiate output transistor 145. There would thus be M switches in array 202 ranging from a switch $S_1$ to an Mth switch $S_M$. Each switch couples between a drain of its corresponding transistor 245 and the emitter terminal for transducer 105. The control signal discussed with regard to FIG. 2A may also control array 202. In this fashion, the current switching process also is implemented in array 202.

Figure 2C:
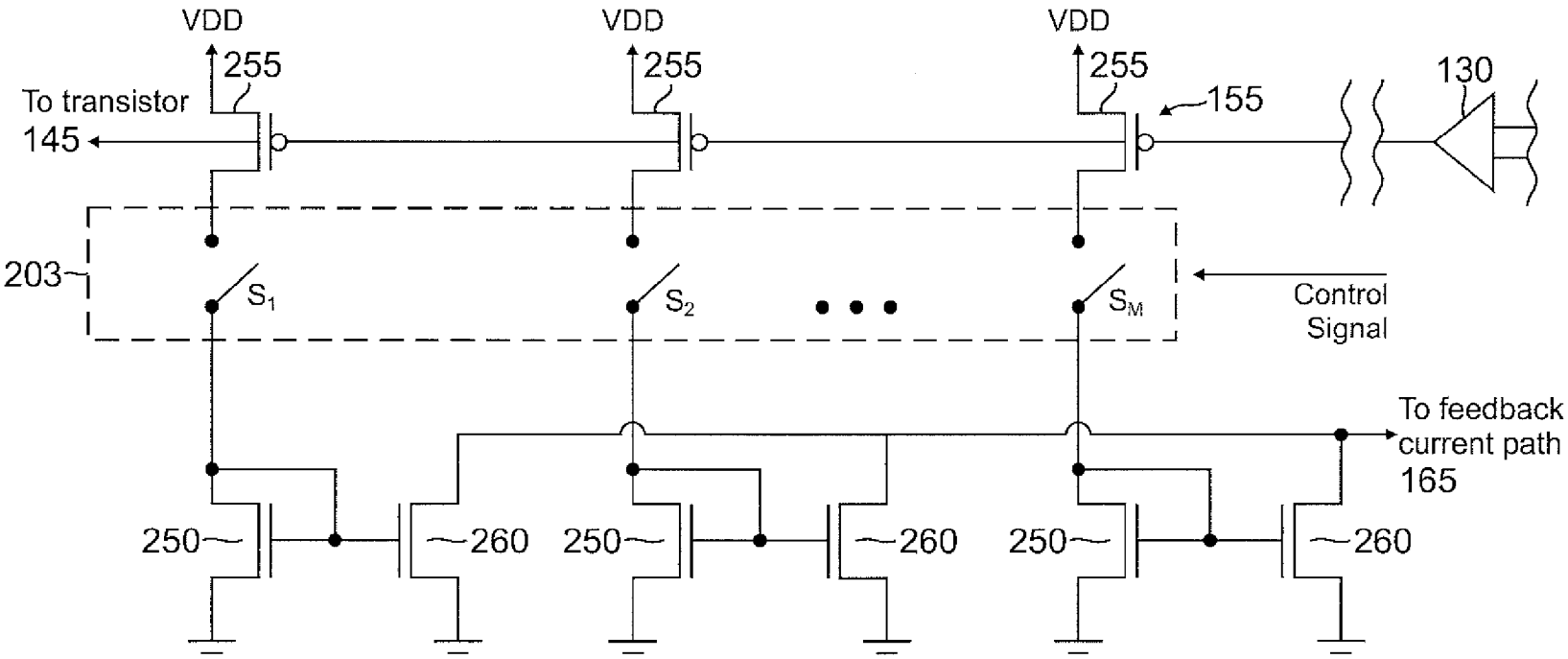
FIG. 2C illustrates an example array of transistors for instantiating the second current mirror in the collector current driver of FIG. 1.

Transistors 245 are matched to an array of PMOS transistors 255 used to instantiate first duplicate output transistor 155 as shown in FIG. 2C. Transistors 255 couple in parallel between the power supply node and an array 203 of corresponding switches 203. If there are M transistors used to instantiate transistor 145 as discussed with regard to transistors 245, there would be M transistors 255 used to instantiate transistor 155 and M corresponding switches in array 203, ranging from a first switch $S_1$ to an Mth switch $S_M$. Similarly, sum current transistor 150 would be instantiated with M transistors 250 and mirror transistor 160 instantiated with M transistors 260. Each transistor 255 couples to a corresponding pair of transistors 250 and 260 as discussed with regard to transistors 155, 150, and 160 in FIG. 1. Thus, the drain of each transistor 260 will sink current from feedback current path 165 when each switch in array 203 is closed. Differential amplifier 130 drives the gates of transistors 255 as discussed with regard to first duplicate output transistor 155.

Figure 2D:
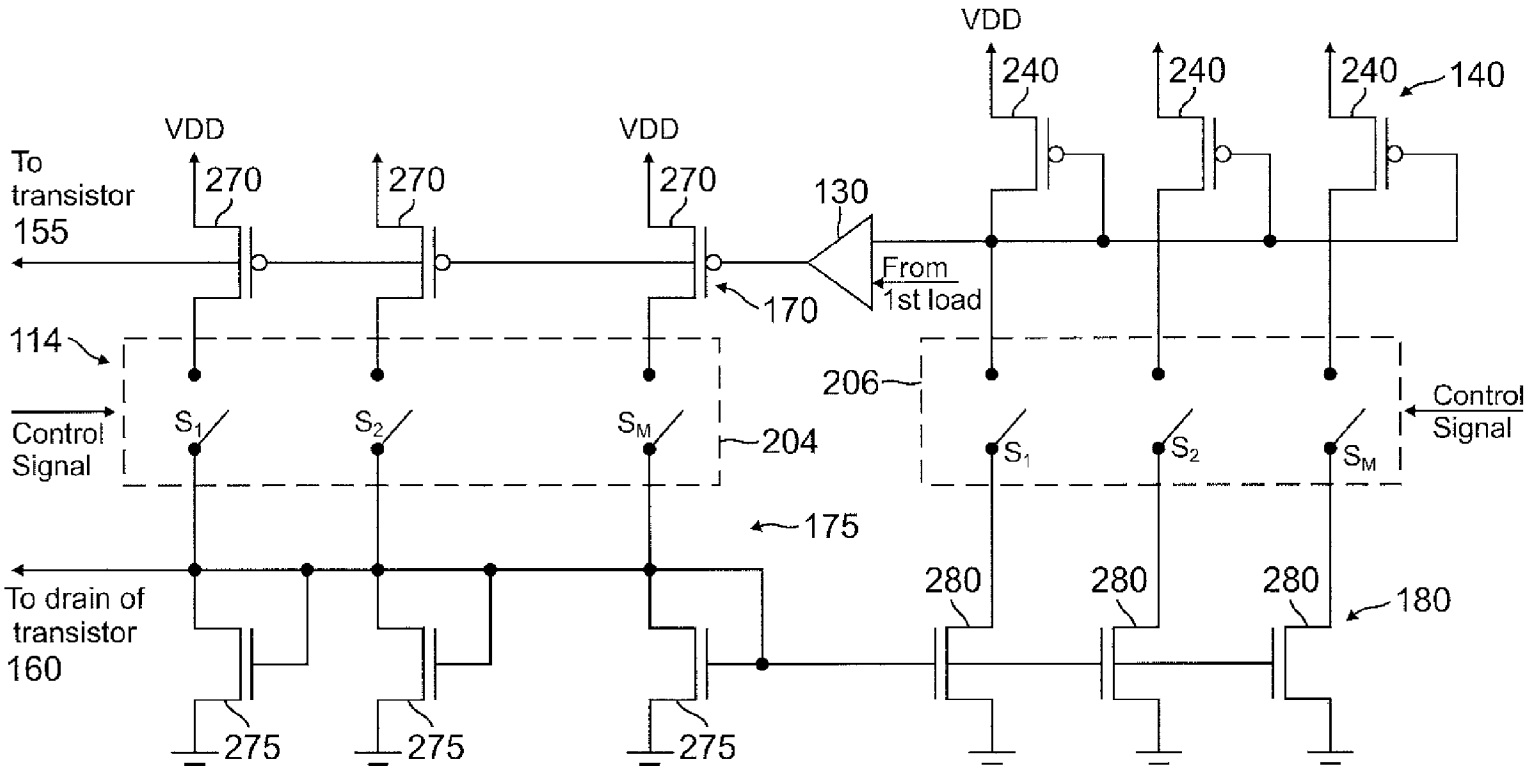
FIG. 2D illustrates an example array of transistors for instantiating the third current mirror in the collector current driver of FIG. 1.

Current mirror 114 of collector current driver 100 may be instantiated as shown in FIG. 2D. Double duplicate output transistor 170 is instantiated using an array of M PMOS transistors 270 coupled in parallel between the power supply node and a corresponding array 204 of switches. Differential amplifier 130 drives the gates of transistors 270 as discussed with regard to double duplicate output transistor 170 of FIG. 1. Similarly, difference transistor 175 is instantiated using an array of M NMOS transistors 275. Each transistor 275 has its drain coupled through a corresponding one of the switches to the drain and gate of a corresponding one of transistors 275. The drains and gates transistors 275 couple to the gates of an array of NMOS transistors 280 that instantiate mirror transistor 180. The sources of transistors 280 all couple to ground whereas their drains couple to corresponding switches in a switch array 206. Similarly, second load transistor 140 is instantiated using M load PMOS transistors 240. Each transistor 270 is configured to be twice the size of each transistor 245 and 255. Alternative transistor arrays may be used. Regardless of the particular array and switch combination, instantiating each transistor using an array of M transistors and corresponding switches is quite advantageous because the resulting collector current is immune to variations in the transducer. Moreover, the transistors in collector current driver 100 are then readily biased for the varying currents used to generate the necessary collector current ratios.

Figure 3:
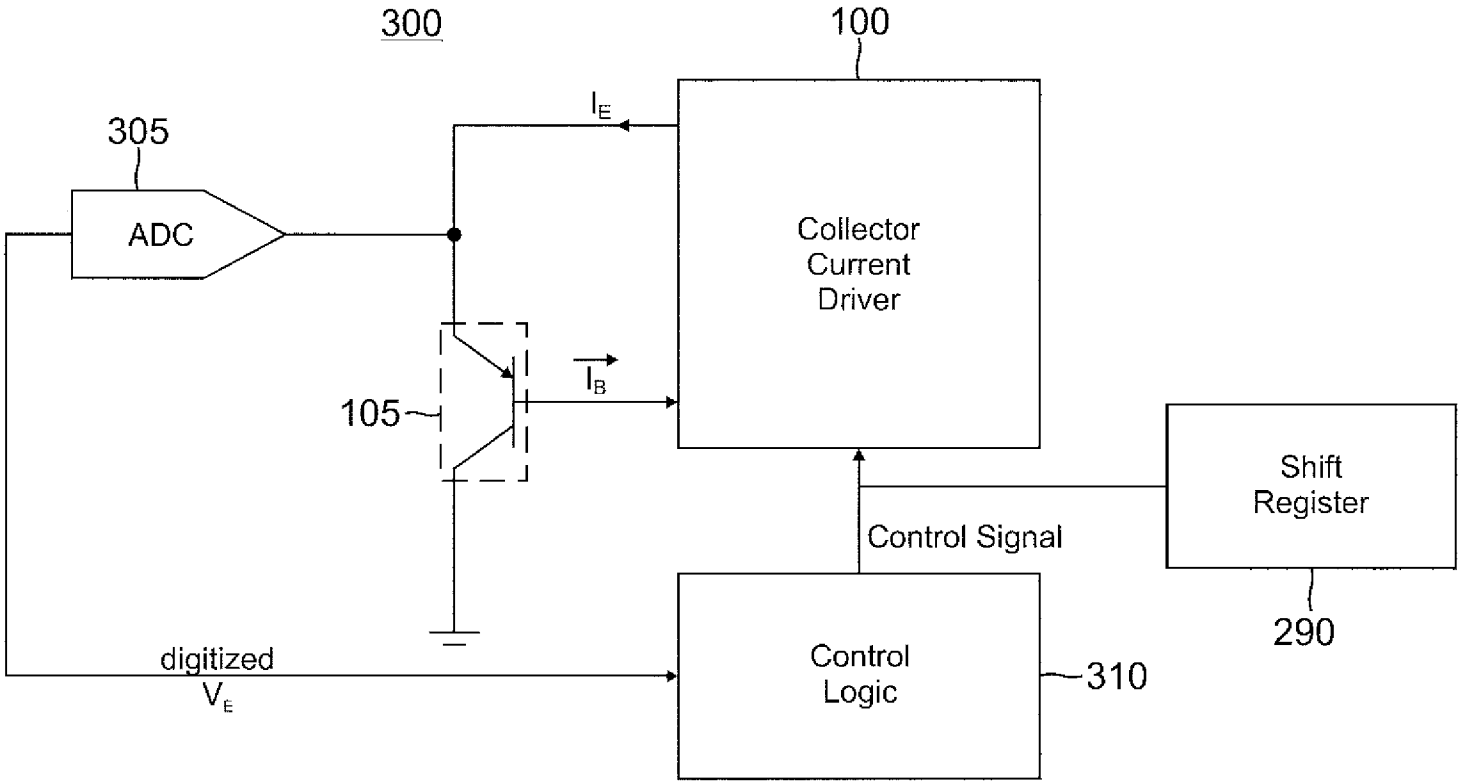
FIG. 3 illustrates a system incorporating the collector current driver of FIG. 1 and a plurality of transistor arrays such as the one shown in FIG. 2.

Collector current driver 100 may be further understood with regard to FIG. 3, which illustrates a system 300 that includes collector current driver 100 configured to be responsive to a control signal as discussed with regard to the switches for the various switch arrays discussed with regard to FIGS. 2A through 2D. Collector current driver 100 controls the collector current for transducer 105 as discussed above. An analog-to-digital converter (ADC) 305 digitizes the resulting emitter voltage for transducer 105 and provides the resulting digitized value to control logic circuit 310. To generate the control signal, control logic circuit 310 may include a shift register 290 (that is shown separately for illustration purposes). Shift register 290 controls the switch arrays to provide accurate current ratios. Operation of shift register 290 is discussed further below. Control logic circuit 310 controls the switch arrays for the transistors 115, 145, 155, 170, 150. For example, control logic circuit 310 could control the control signal such that a first collector current is driven out of transducer 105. Control logic circuit 310 may then change the control signal such that a second collector current is driven out of transducer 105, where the second collector current has a known relationship to the first collector current through the use of the transistor arrays and shift register 290 discussed above. For example, the second collector current may be M times the first collector current using the arrays of M transistors discussed above. The ratio of the second collector current to the first collector current would then equal M. Control logic circuit 310 may be configured to store the logarithm of M accordingly. A temperature measurement would then be performed by control logic circuit 310 by processing a difference of the emitter voltages for the two emitter current values as obtained through ADC 305 with the appropriate proportionality factors and the stored logarithm value.

In particular, ADC 305 may digitize the voltage across PNP bipolar transistor temperature transducer 105 in each frame. In one embodiment, ADC 305 may comprise an oversampling ADC 305. In this fashion, a Delta-Sigma modulation, may be utilized to process the voltage signal resulting from the output currents and obtain an average output quantity across the frames in a current generation cycle.

Additional circuit error correction mechanisms also may be embedded in an ADC conversion cycle, such as chopping signals for mitigating amplifier offset in the voltage signal generation path. In this case, the process described above may be repeated for each state of chopping signal so that the impact of the offset may be averaged by the ADC as well.

Figure 7:
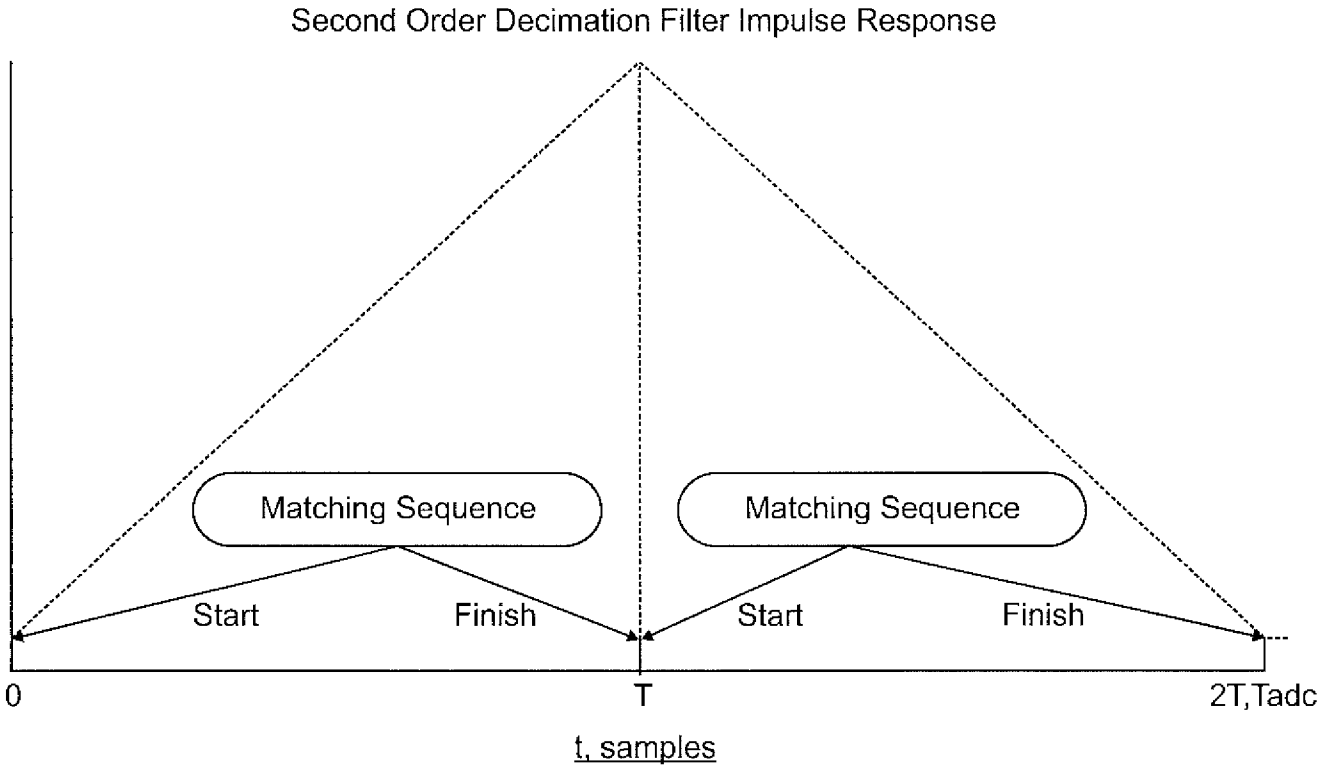
FIG. 7 illustrates a second order decimation filter impulse response from a higher level. ADC in accordance with an embodiment of the disclosure.

When higher level ADCs with non-rectangular, but symmetric impulse responses, are used, at least two switching cycles, e.g., 2T, may be sampled such that all combinations of transistors may experience equivalent weighting by the response. As shown in FIG. 7, two cycles of sampling may be taken. This may result in accurate averaging over the ADC conversion cycle.

Although the above embodiments use current outputs and the current ratios for temperature measurement in a PNP bipolar transistor temperature transducer, other applications that require accurate current ratios also may utilize the above system and method to obtain accurate current ratios suitable for other applications.

An example method of operation for a collector current driver will now be discussed.

Example Method of Operation

Figure 4:
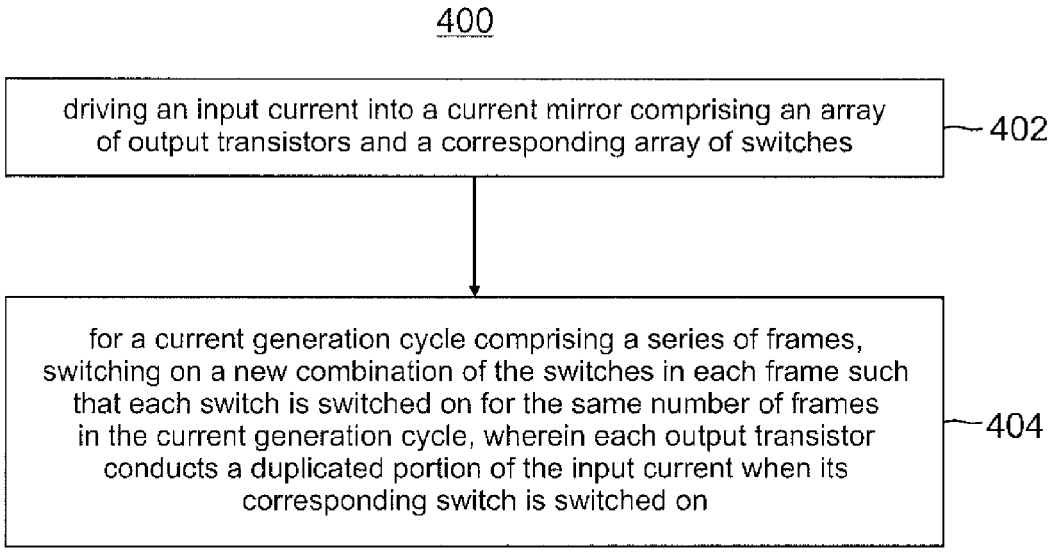
FIG. 4 is a flowchart for an example method of operation for the collector current driver of FIG. 1.

As shown in the flowchart of FIG. 4, a method of operation for an example current driver includes an act 400 of driving an input current into a current mirror comprising an array of output transistors and a corresponding array of switches. An example of this act is current source 11 driving the current mirror comprising the output transistors the corresponding array 12 of switches in FIG. 1A. Method 400 continues with an act 405 of for a current generation cycle comprising a series of frames, switching on a new combination of the switches in each frame such that each switch is switched on for the same number of frames in the current generation cycle, wherein each output transistor conducts a duplicated portion of the input current when its corresponding switch is switched on. For example, by utilizing shift register 290, control logic 310 may progressively switch on a number N of the switches in each frame such that each switch is turned on the same number of frames in the current generation cycle. A shift register embodiment will now be discussed in more detail.

Shift Register Operation

Figure 5:
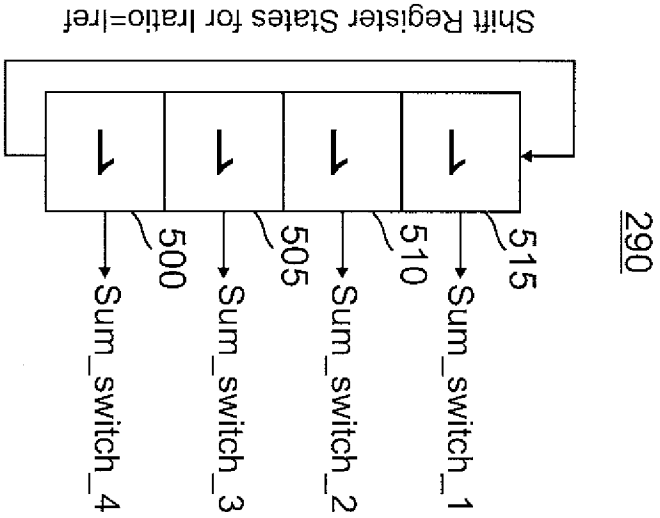
FIG. 5 illustrates a shift register in accordance with an embodiment of the disclosure.

Each switch array has an array of M switches corresponding to the M output transistors. Shift register 290 may then include M flip-flops corresponding to the M switches. Each flip-flop controls the on and off state of its corresponding switch. For example, FIG. 5 shows a shift register 290 for controlling the four switches in array 12 of FIG. 1A. There are four flip-flops including a first flip-flop 515, a second flip-flop 510, a third flip-flop 505, and a fourth flip-flop 500. Each flip-flop controls its respective switch through a corresponding sum_switch command. Thus, first flip-flop 515 controls switch $S_1$ (not illustrated) through a sum_switch 1 command, second flip-flop 510 controls switch $S_2$ (not illustrated) through a sum_switch 2 command, and so on.

Prior to the cycling through of the frames in a current generation cycle, a number N of the flip-flops are set (storing a binary one). This pattern of binary ones is then shifted through the shift-register 290 according to the frame rate. For example, as shown in FIG. 5, a pattern of all ones may be loaded into shift register 290. Each switch will thus be on in each frame in that the pattern of all ones simply recycles through shift register 290 at each successive frame. The result is that the output transistors in FIG. 1A would sink a total current equaling the total current from current source 11.

Figure 6:
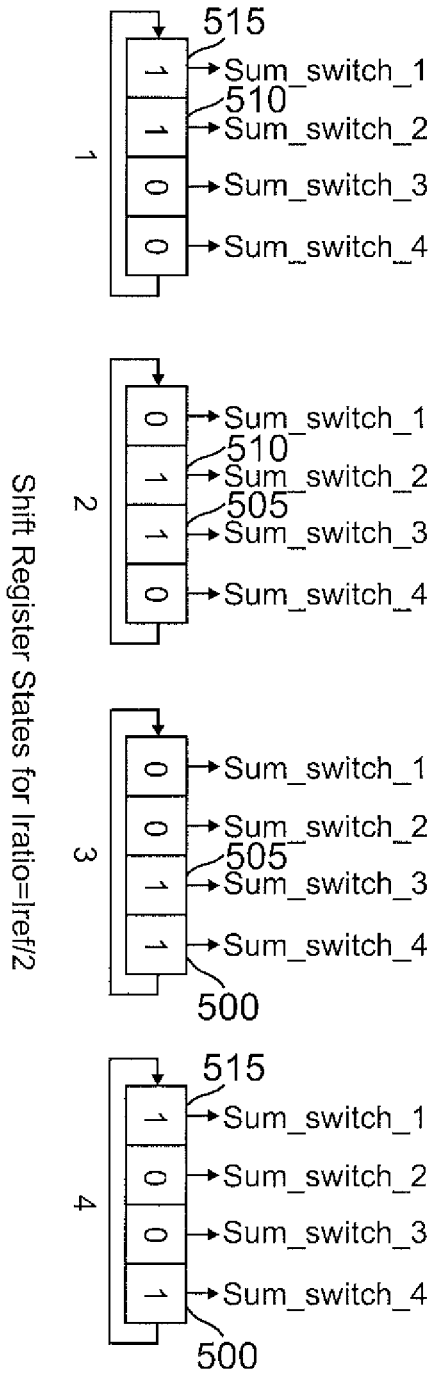
FIG. 6 illustrates a shift register in four different states of switching in accordance with an embodiment of the disclosure.

A more interesting pattern results if the number N of flip-flops storing a binary one is less than M. For example, FIG. 6 illustrates the flip-flop states for four frames, ranging from a frame 1 to a frame 4. In frame 1, only the first and second flip-flops 515 and 510 store a binary one. The switches $S_1$ and $S_2$ will thus be on in this frame. This pattern of binary ones is shifted by one flip-flop position in frame 2 such that only second and third flip-flops 510 and 505 store a binary one. Thus, only switches $S_2$ and $S_3$ will be on in frame 2. Similarly, the pattern of binary ones is shifted forward one flip-flop position in a frame 3 such that only third and fourth flip-flops 505 and 500 store a binary one. Switches $S_3$ and $S_4$ will be on in frame 3. Finally, the pattern of binary ones is again shifted in frame 4 such that only first and fourth flip-flops 515 and 500 store a binary one. Switches $S_1$ and $S_4$ are thus on in frame 4. It will thus be readily appreciated that shift register 290 is a convenient way to enforce that each switch to be on the same number of frames in the current generation cycle while the combination of the N on switches changes in each frame.

The measuring of the resulting voltage that is produced by the N switched-on switches in each frame may be conducted over multiple current generation cycles. For example, it is advantageous to use two current generation cycles when higher-level ADCs with non-rectangular, but symmetric impulse responses, are used, as shown in FIG. 7. This may result in accurate averaging over the ADC conversion cycle.

It will be appreciated that the techniques and concepts discussed herein are not limited to the specific disclosed embodiments. The appended claims encompass all such changes and modifications as fall within the true spirit and scope of this invention.

I claim:

1. A circuit, comprising:

a current source;

a plurality of first transistors coupled in parallel to the current source such that each first transistor conducts a target current;

a plurality of second transistors matched to the plurality of first transistors;

a plurality of switches corresponding to the plurality of second transistors, each switch being coupled in series with its corresponding second transistor, wherein the plurality of second transistors and the plurality of first transistors comprise a current mirror such that each second transistor conducts the target current when its corresponding switch is on;

a control logic circuit configured to cycle the switches on and off with regard to frames over a current generation cycle such that each switch is on in the same number of frames in the current generation cycle, wherein the control logic circuit comprises a shift register having a plurality of flip-flops corresponding to the plurality of switches, wherein each flip-flop is configured to control its corresponding switch;

a bipolar junction transistor temperature transducer; and an Analog-to-Digital Converter (ADC) configured to digitize a voltage across the bipolar junction transistor temperature transducer to produce a digitized voltage, and to drive the control logic circuit with the digitized voltage.

2. The circuit of claim 1, wherein the plurality of second transistors comprises M second transistors, M being an integer greater than one, and wherein a length of the shift register equals M.

3. The circuit of claim 1, wherein the plurality of first transistors and the plurality of second transistors comprise NMOS transistors.

4. A method, comprising:

driving an input current into a current mirror comprising an array of output transistors and a corresponding array of switches;

for each frame in a series of frames in a current generation cycle, switching on a new combination of the switches such that each switch is switched on the same number of frames in the current generation cycle, wherein each output transistor conducts a portion of the input current when its corresponding switch is switched on;

mirroring the input current through a temperature transducer as a load, and averaging a voltage across the temperature transducer for the frames using an oversampling Analog-to-Digital Converter (ADC).

5. The method of claim 4 wherein driving the input current comprises driving the input current into an array of reference transistors.

6. The method of claim 5, wherein switching on a unique combination of the switches in each frame comprises shifting a binary pattern through a shift register.

7. The method of claim 6, wherein the shift register includes a plurality of flip-flops and wherein the binary pattern is shifted by one flip-flop every frame.

8. The method of claim 4, further comprising:

determining a temperature based on a current ratio generated from the current mirror and the voltages measured across the temperature transducer.

9. The method of claim 8, wherein the temperature is determined based on a natural log of the current ratio.

10. A circuit, comprising:

a current source configured to source an input current;

a plurality of first transistors coupled in parallel to the current source such that each first transistor conducts a reference current;

a plurality of second transistors matched to the plurality of first transistors;

a plurality of switches corresponding to the plurality of second transistors, each switch being coupled in series with its corresponding second transistor, wherein the plurality of second transistors and the plurality of first transistors comprise a current mirror such that each second transistor conducts a duplicate of the reference current when its corresponding switch is on;

a control logic circuit configured to cycle the switches on and off with regard to frames over a current generation cycle such that each switch is on in the same number of frames in the current generation cycle;

a differential amplifier configured to compare a total current conducted by the second transistors to a duplicate difference current to generate a feedback voltage; and an output transistor responsive to the feedback voltage and configured to source an emitter current to a bipolar transistor.

11. The circuit of claim 10, further comprising a difference circuit configured to subtract a sum current equaling a sum of the emitter current and a base current for the bipolar transistor from a first current equaling twice the emitter current to produce a difference current;

a difference current mirror configured to duplicate the difference current to provide the duplicate difference current.

12. The circuit of claim 11, further comprising:

a first load; and a second load, wherein the differential amplifier is configured to compare the total current to the duplicate difference current responsive to voltages developed at a terminal for each of the first and second loads.

13. The circuit of claim 11, further comprising:

a duplicate output transistor matched to the output transistor, wherein the duplicate output transistor is configured to drive a summing current mirror with a duplicate of the emitter current responsive to the feedback voltage.

14. The circuit of claim 11, wherein the bipolar transistor is a PNP bipolar transistor.

* * * * *